US006820305B2

(12) United States Patent
Albert et al.

(10) Patent No.: US 6,820,305 B2
(45) Date of Patent: Nov. 23, 2004

(54) VACUUM CLEANER WITH ACCESSORIES

(75) Inventors: Wilma Albert, Wülfershausen (DE); Martin Jessenberger, Eussenhausen (DE); Herbert Kess, Bad Neustadt (DE); Andreas Schlereth, Bad Neustadt (DE); Thomas Seith, Bad Neustadt (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/646,176

(22) Filed: Aug. 22, 2003

(65) Prior Publication Data

US 2004/0045127 A1 Mar. 11, 2004

Related U.S. Application Data

(63) Continuation of application No. PCT/EP02/01583, filed on Feb. 14, 2002.

(30) Foreign Application Priority Data

Feb. 22, 2001 (DE) ..... 101 08 639

(51) Int. Cl.[7] ..... A47L 9/02; A47L 9/06

(52) U.S. Cl. ..... 15/415.1; 15/398; 15/416

(58) Field of Search ..... 15/393, 398, 415.1, 15/416

(56) References Cited

U.S. PATENT DOCUMENTS

| | | | | |
|---|---|---|---|---|
| 2,351,507 A | * | 6/1944 | Lay | 15/415.1 |
| 3,259,934 A | | 7/1966 | Leinfelt | |
| 4,897,894 A | * | 2/1990 | Fahlen | 15/365 |
| 5,502,870 A | | 4/1996 | Ragner et al. | |
| 5,621,946 A | | 4/1997 | Lee | |
| 5,732,438 A | | 3/1998 | Tuvin et al. | |
| 5,826,301 A | * | 10/1998 | Kang et al. | 15/416 |
| 5,839,161 A | | 11/1998 | Liang | |
| 6,032,328 A | | 3/2000 | Harmon et al. | |

FOREIGN PATENT DOCUMENTS

| | | |
|---|---|---|
| DE | 296 10 327 U1 | 9/1996 |
| DE | 199 00 649 A1 | 7/2000 |
| EP | 0 263 085 A2 | 4/1988 |
| EP | 0 747 000 A1 | 12/1996 |
| JP | 11285463 A | 10/1999 |

* cited by examiner

*Primary Examiner*—Terrence R. Till
(74) *Attorney, Agent, or Firm*—Laurence A. Greenberg; Werner H. Stemer; Ralph E. Locher

(57) ABSTRACT

A vacuum cleaner includes several attachments and an attachment unit for accommodating the attachments. The attachment unit of the vacuum cleaner incorporates a crevice tool, an upholstery tool, or an upholstery brush. The attachments are connected to the attachment unit in a force fit and/or positive fit. The attachment unit, preferably, has a base body, to which the crevice tool and/or the upholstery tool and/or the upholstery brush is/are connected.

27 Claims, 5 Drawing Sheets

VACUUM CLEANER WITH ACCESSORIES

CROSS-REFERENCE TO RELATED APPLICATION

This application is a continuation of copending International Application No. PCT/EP02/01583, filed Feb. 14, 2002, which designated the United States and was not published in English.

BACKGROUND OF THE INVENTION

Field of the Invention

The invention relates to a vacuum cleaner with an accessory unit for a plurality of accessory parts.

Vacuum cleaners have, alongside the floor nozzle fitted at one end of the suction tube, further accessory parts that are adapted for specific vacuuming functions. It is, thus, known to have, for example, furniture nozzles, crevice nozzles, and upholstery nozzles that either can be plugged onto the end of the suction tube or are plugged onto a tube component that directly adjoins the end of the suction hose.

European Patent Application EP 0 747 000; B1, corresponding to U.S. Pat. No. 5,732,438 to Tuvin et al., discloses a holder for accessory parts that accommodates a crevice nozzle on one side and a floor nozzle on the other side. The holder is fastened in a releasable manner, by way of its front and its rear parts, on a handle of a suction tube for a vacuum cleaner.

SUMMARY OF THE INVENTION

It is accordingly an object of the invention to provide a vacuum cleaner with accessories that overcomes the herein aforementioned disadvantages of the heretofore-known devices of this general type and that provides a mount for accessory parts that can easily be fastened on the vacuum cleaner.

With the foregoing and other objects in view, there is provided, in accordance with the invention, an accessory unit of vacuum cleaner, including a base body and a plurality of accessory parts including a crevice nozzle and at least one of a furniture nozzle and a furniture brush, the accessory parts being connected in at least one of a force-fitting manner and a form-fitting manner to the base body, the crevice nozzle telescopically extending out of the base body.

The accessory unit accommodates at least one crevice nozzle, a furniture nozzle, or a furniture brush and the accessory parts are connected in a force-fitting and/or form-fitting manner with the accessory unit. A force-locking or force-fitting connection is one that connects two elements together by force external to the elements, as opposed to a form-locking or form-fitting connection, which is provided by the shapes of the elements themselves.

In the case of the vacuum cleaner according to the invention, a previously three-part set of small accessories, including a furniture nozzle, a crevice nozzle, and a furniture brush (also referred to as a suction brush) is united to form a combined functional unit. The parts of the accessory unit can be combined in any manner and can be connected removably to a hose assembly of a vacuum housing.

The invention provides a combination of a crevice nozzle with a furniture brush, for example, in conjunction with a telescopic furniture nozzle, it being possible for the furniture brush to be extended in the longitudinal direction of the functional unit, for example, through guide measures.

The invention provides a base body to which the crevice nozzle and/or the furniture nozzle and/or the crevice nozzle is connected. This is, advantageously, constructed such that the crevice nozzle can be moved out of the base body directly or through guide measures.

In accordance with another feature of the invention, the crevice nozzle can be extended telescopically out of the base body. Preferably, the telescopically extensible parts are tube components disposed one inside the other.

In accordance with a further feature of the invention, the telescopically extensible parts have end positions and are latched in the end positions.

In accordance with an added feature of the invention, the crevice nozzle has first and second parts, the first part disposed inside the second part and telescopically extending from the second part.

In accordance with an additional feature of the invention, the first and second parts have end positions and are removably latchable in the end positions.

With the objects of the invention in view, there is also provided an accessory unit, including a base body having an end side and a lateral wall and a plurality of accessory parts, including a furniture brush and at least one of a crevice nozzle and a furniture nozzle, the accessory parts being connected in at least one of a force-fitting manner and a form-fitting manner to the base body, the furniture brush having a sleeve enclosing the lateral wall of the base body in a circular manner and extending beyond the end side by rotation of the sleeve.

The furniture brush can, likewise, advantageously be extended out of the base body.

In accordance with yet another feature of the invention, the furniture brush is, preferably, disposed on that side of the base body that is located opposite the furniture nozzle, as seen in the direction of extension. It is possible, here, for the furniture brush to be, preferably, arrested on the base body in the extended position.

In accordance with yet a further feature of the invention, the furniture brush is disposed in the form of a ring at the end of a wall of the base body.

In accordance with yet an added feature of the invention, the furniture brush is disposed such that it can be displaced in the region between an inner wall and an outer wall of the base body. The furniture brush may be disposed in the base body such that it can be displaced through a guide.

It may be provided, according to the invention, that the furniture brush can be latched in the guide in at least one position.

One embodiment of the invention provides that the furniture nozzle is disposed on the base body on the side of the furniture brush. In such a case, the furniture nozzle is, advantageously, disposed in a displaceable manner on the outside of the base body.

A particularly suitable embodiment is one in which the furniture nozzle is disposed in a pivotable manner on the outside of the base body and pivots from a rest position to an operating position Easy handling is achieved if the furniture nozzle can be arrested on the base body in the operating position.

In accordance with yet an additional feature of the invention, the furniture nozzle can be displaced through two protuberances disposed on the outside of the base body and can be pivoted about the protuberances into an operating position and a rest position.

In such a case, the furniture nozzle is fastened on the base body through fastening measures and is of an elastic material. The furniture nozzle is configured such that it can be removed from the base body, and can be fastened on the outside of the base body in the operating position and, rotated through 180° in relation to the operating position, in a rest position.

For such a releasable fastening, the furniture nozzle has two openings into which protuberances project.

If use is made of such a nozzle, the base body is enclosed by a sleeve that is disposed on the base body such that it can be displaced through two ribs, which are located opposite one another, through 180°, on the outer lateral wall of the base body.

In accordance with again another feature of the invention, the elements of the nozzle can be swung through hinges that are fitted at the open ends of the ribs. The elements are connected to the base body in each case through a folding bellows or through an airtight on a sleeve engaging over the base body.

In accordance with again a further feature of the invention, the furniture brush is disposed at the end side of the base body and is to be plugged, by the end side, one of onto and into a vacuum-cleaner tube component.

In accordance with again an added feature of the invention, the furniture nozzle is arrested removably on the base body in at least one of an operating position and a rest position.

In accordance with again an additional feature of the invention, the furniture nozzle is of an elastic material and has an interrupted wall permitting the furniture nozzle to pivot out of the operating position into the rest position, in which the furniture nozzle is rotated approximately 180° with respect to the operating position.

In accordance with still another feature of the invention, the vacuum cleaner is characterized by a nozzle that is made up of symmetrical elements that are fastened on the base body and can be displaced in the longitudinal direction. The elements are, additionally, disposed in a pivotable manner.

With the objects of the invention in view, there is also provided an accessory unit, including a base body having a longitudinal direction, a sleeve displaceably disposed on the base body, and a plurality of accessory parts, including a crevice nozzle and a furniture nozzle, the parts being connected in at least one of a force-fitting manner and a form-fitting manner to the base body and forming on the base body a nozzle of two elements symmetrical with respect to one another in the longitudinal direction, the two elements having hinges pivotally mounting the two elements on the base body between a swung-together position in which the elements form the crevice nozzle and a swung-out position in which the elements form the furniture nozzle, the sleeve pivoting the elements when displaced on the base body.

To ensure that the elements of the nozzle can be arrested in the desired position, the elements are connected to the sleeve in each case through hinges or flexible lugs made of an elastic material.

To make possible integration of the base body together with the various nozzle forms between components of a suction tube, the elements can be swung to an acute angle in relation to one another. As a result, they accommodate a tube component in an air-tight manner between them.

In accordance with still a further feature of the invention, there are provided sealing surfaces connecting the elements to the base body.

In accordance with still an added feature of the invention, the sealing surfaces are elastic folding bellows.

To form a crevice nozzle, the elements can be swung together and each have, at their open ends, surfaces that are curved in relation to one another and also, on their outer lateral borders, ribs of a height that corresponds to, or is less than, half the height in each case of the rib on the base body In the swung-together state, the elements, thus, form a mouth-like opening for a crevice nozzle, the sleeve, at the same time, covering the hinges through which the elements are connected to the base body.

Alternatively, the elements can be swung out from the base body at right angles to the rib of the latter to form an upholstery nozzle.

The accessory part achieves a third function in that, on a side of the base body that is located opposite the swing-together elements, a furniture brush, which can be extended in ring form beyond the end side of the lateral wall of the base body, is fitted on the base body.

The furniture brush is, preferably, disposed on a sleeve that encloses the lateral wall in a circular manner, is guided on the base body through a guide and can be extended beyond the end side of the base body by rotation of the sleeve.

It is also possible for the base body to be plugged, by way of the end sides that make up the furniture brush, onto a vacuum-cleaner tube component or into a vacuum-cleaner tube component.

Alternatively, the furniture nozzle is disposed in a displaceable manner on the inside of the base body.

In accordance with still an additional feature of the invention, the accessory unit can be disposed in a removable manner in an open-ended handle, the handle being disposed on a suction-hose/suction-tube unit of a vacuum cleaner.

The accessory combination in the embodiments illustrated above can be fastened in vacuum cleaners between tube components, on a handle or, by securing measures, on a vacuum-cleaner tube or a vacuum-cleaner hose. Such securing measures, preferably, are an elastic material, for example, a plastic.

In accordance with a concomitant feature of the invention, the accessory combination is fastened on a vacuum-cleaner housing. For such a purpose, the housing has, for example, on a side that extends substantially perpendicularly to the floor surface, a groove in which the accessory combination is fastened in a form-fitting or force-fitting manner.

Other features that are considered as characteristic for the invention are set forth in the appended claims.

Although the invention is illustrated and described herein as embodied in a vacuum cleaner with accessories, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
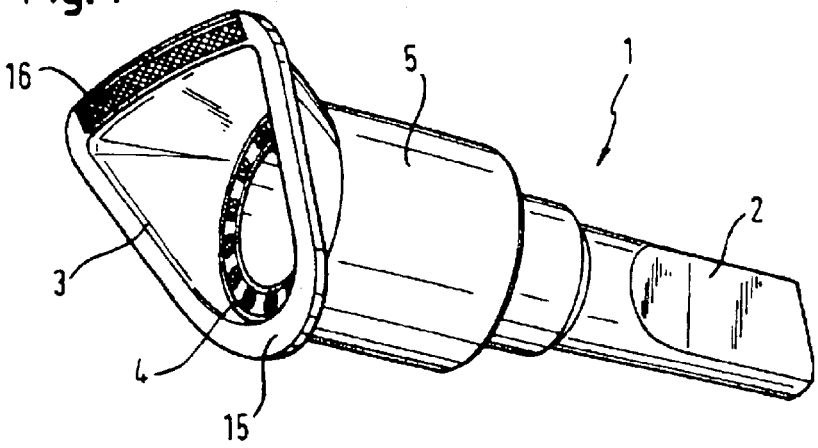
FIG. 1 is a perspective view of an accessory unit according to the invention.

Referring now to the figures of the drawings in detail and first, particularly to FIG. 1 thereof, there is shown an accessory unit 1 that accommodates a crevice nozzle 2, a furniture nozzle 3, and a furniture brush 4. The crevice nozzle 2, the furniture nozzle 3, and the furniture brush 4 are connected either in a force-fitting or in a form-fitting manner to the accessory unit 1. The furniture nozzle 3 has a peripheral border 15, which is provided with a velour strip 16 on its operating edge.

The accessory unit 1 has a base body 5, which bears the crevice nozzle 2, the furniture nozzle 3, and the furniture brush 4.

Figure 2:
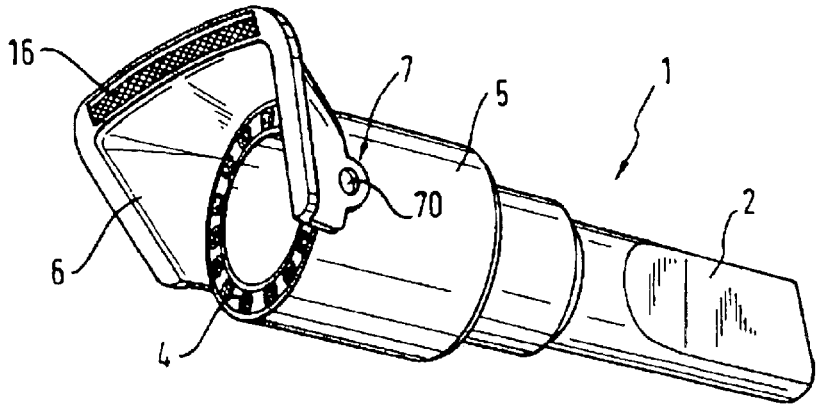
FIG. 2 is a perspective view of a second embodiment of the accessory unit according to the invention.

Instead of the furniture nozzle 3, it is also possible to use a furniture nozzle 6 shown in FIG. 2, which can be pivoted through hinges 7, fitted on the outer wall of the base body 5, and which has an interrupted wall to allow the pivoting operation. For such a purpose, the hinges 7 each have a protuberance 70.

Figure 3:
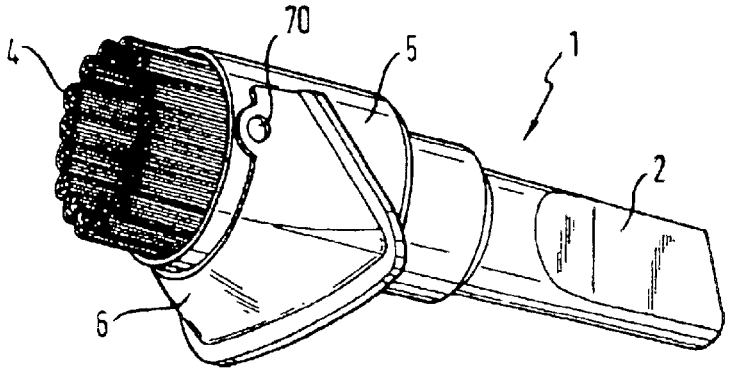
FIG. 3 is a perspective view of the accessory unit of FIG. 2 with the nozzle in a pivoted position and a brush in an extended position.

When the furniture nozzle 6 is pivoted back as shown in FIG. 3, the furniture brush 4 can be extended out of the base body 5 to vacuum up an object.

Figure 4:
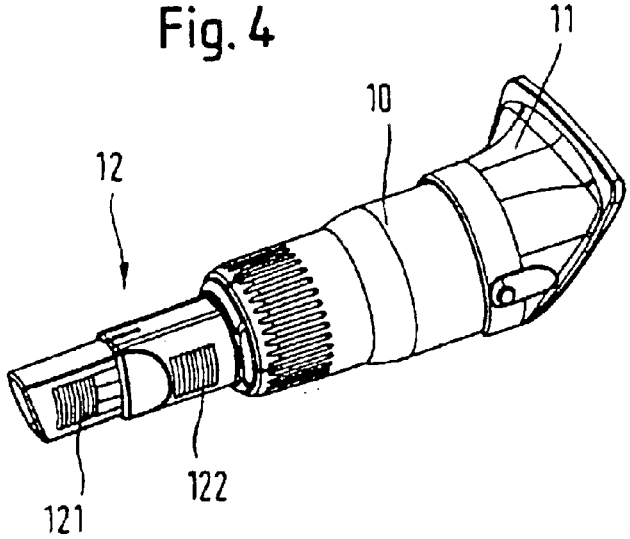
FIG. 4 is a perspective view of a third embodiment of the accessory unit according to the invention with a telescopic nozzle in a retracted position.
Figure 5:
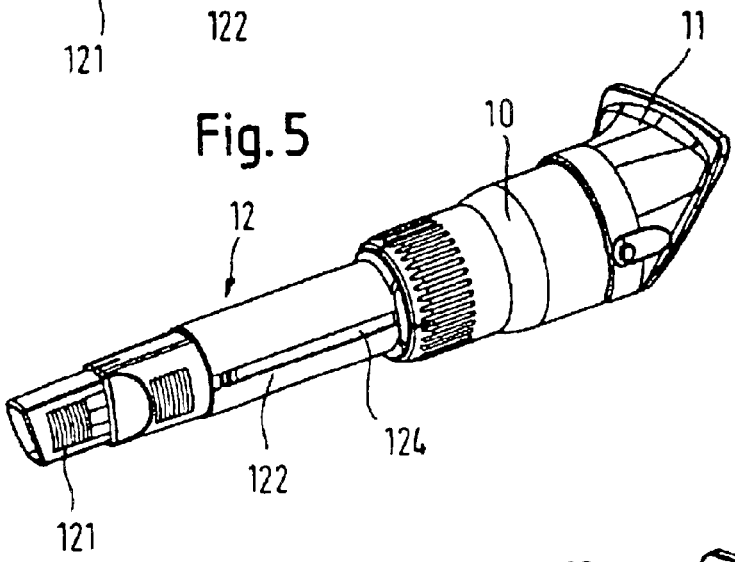
FIG. 5 is a perspective view of the accessory unit of FIG. 4 in a further extended position.
Figure 6:
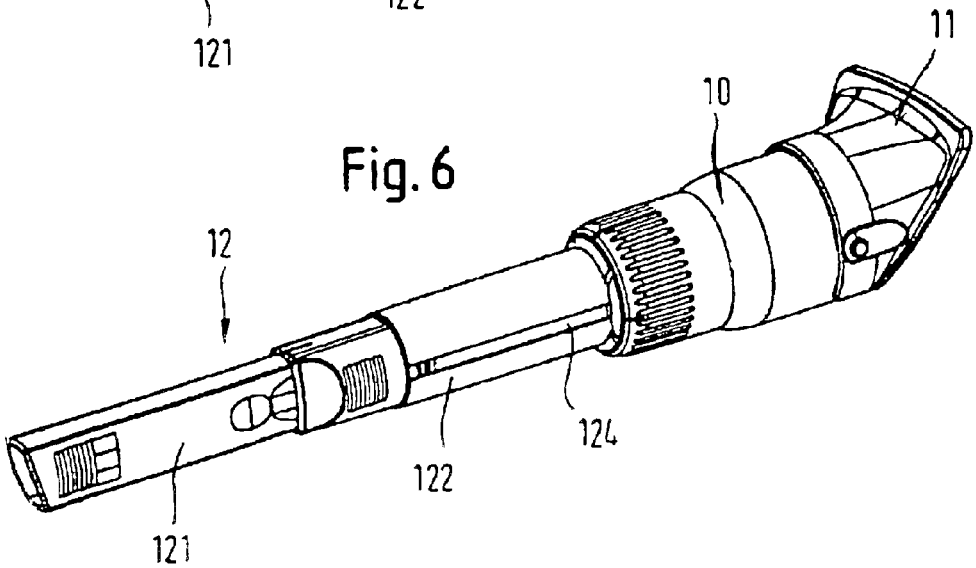
FIG. 6 is a perspective view of the accessory unit of FIG. 5 in a further extended position.

A further exemplary embodiment of the nozzle according to the invention is shown in FIGS. 4 to 6, wherein a base body 10 has a pivotable furniture nozzle 11 and a crevice nozzle 12 that can be extended telescopically out of the base body 10 and is constructed in two parts 121 and 122 that form tube components located one inside the other and that can be extended one after the other out of the base body 10, this resulting in three stages of extension, as is illustrated in FIGS. 4 to 6. Provided for guiding the parts 121 and 122 in each case are guide grooves 124 (the opposite guide groove not illustrated in the view of FIGS. 4 to 6), into which project corresponding protrusions of the part 121 or 122 that is to be guided in each case. The parts 121, 122 can, preferably, be latched in the end positions.

An accessory unit 8 shown in FIGS. 7 to 10 has a base body 20 with two ribs 21 on its outer lateral wall that are located opposite one another through 180°. Guided on these ribs is a sleeve 22, which has grooves that are directed toward the ribs 21 and are formed by ribs 23 of the sleeve 22.

A nozzle 24 (FIG. 7) is formed by two pivotable elements 25, 26 that can be opened at different angles. The elements 25, 26 are connected respectively to the base body 20 through elastic folding bellows 27, 28. Hinges 37 (FIG. 8) are located in each case between the elements 25, 26 and the folding bellows 27, 28. The elements 25, 26 are connected to the sleeve 22 in each case through flexible lugs 29, 30 or elastic hinges. In addition, the elements 25, 26 have, on their lateral borders, ribs 31, 32, the height of which is dimensioned such that, located one beside the other, they are no thicker than the rib 21, with the result that the sleeve can be drawn over the elements 25, 26 in the direction of arrow A in FIG. 7 when they are swung in the direction (arrow B) of the center. For the air-tight connection of the suction tube 40 (see FIG. 10) with a tube end component 41, the elements 25, 26 are swung laterally onto the lateral wall of the tube end component 41 and have an inner surface that is curved such that they fit snugly against the outer wall of the tube end component 41.

Provided on a side of the base body 20 that is directed away from the nozzle 24 is a furniture brush 33, which encloses the outer wall of the base body 20 in ring form and is retained in a radially movable sleeve 34 through a guide. By rotating the sleeve 34, the furniture brush 33 can move in the axial direction of the base body 20. As a result, the bristles extend beyond the outer edge 35 of the latter. The guide preferably has a plurality of latching positions into which a protuberance, projecting out of the bristle-retaining ring, can latch. As a result, the bristles project beyond the outer border of the base body 20 in accordance with the bristle length desired by the user.

Figure 8:
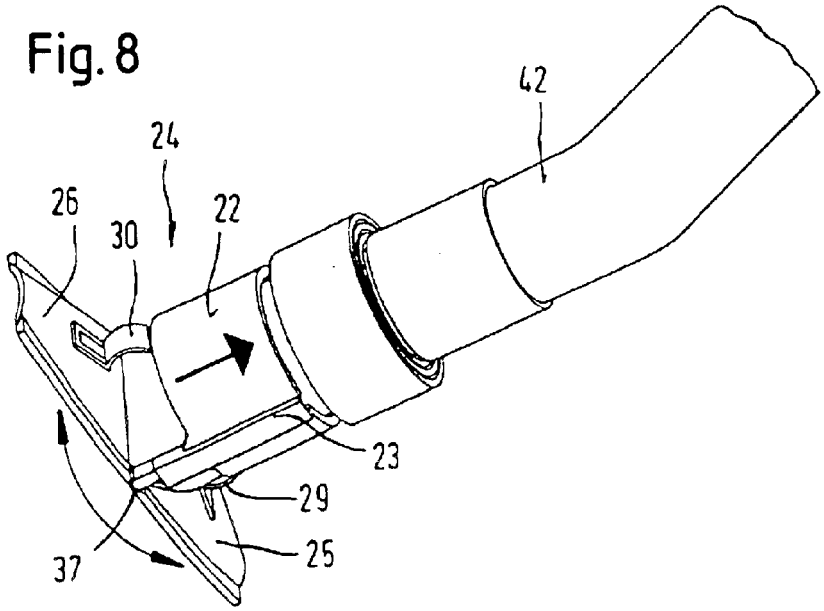
FIG. 8 is a fragmentary, perspective view of the accessory unit of FIG. 7 in a swung open position.

The nozzle 24 shown in FIG. 8 can be swung open such that the elements 25, 26 are swung away from one another through 180°. During the swinging action, the sleeve 34, which is connected to the elements 25, 26 through the lugs 29, 30, is also moved in the direction of the furniture brush 33. This movement is made possible through the rib 21 of the base body 20. In such a case, the element s 25, 26 form a furniture nozzle, the velour surfaces that serve as thread-lifting measures preferably being present in the region of the ribs 31, 32, on the side that is directed toward the furniture surface.

Figure 9:
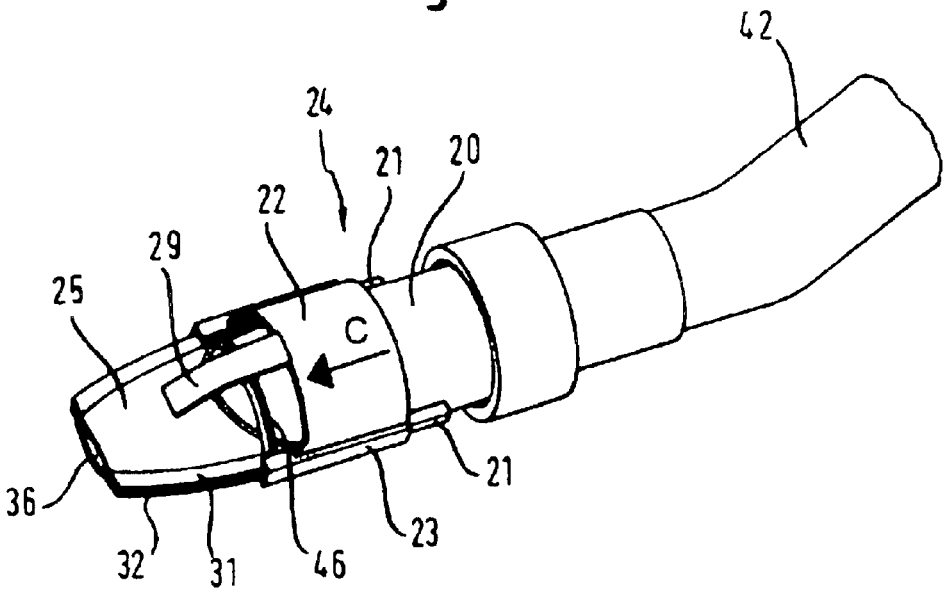
FIG. 9 is a fragmentary, perspective view of the accessory unit of FIG. 7 in a swung closed position.

Alternatively, it is also possible for the elements 25, 26 to be swung together to the full extent as shown in FIG. 9. As a result, they rest closely one upon the other in the region of the ribs 31, 32 and a narrow mouth-like opening 3 6 is produced, this forming an upholstery nozzle. When the elements 25, 26 are swung together, the sleeve is pushed, through the lugs 29, 30, in the direction of the swinging-together ribs 31, 32 and covers over the latter in the region adjacent to the base body 20.

Figure 7:
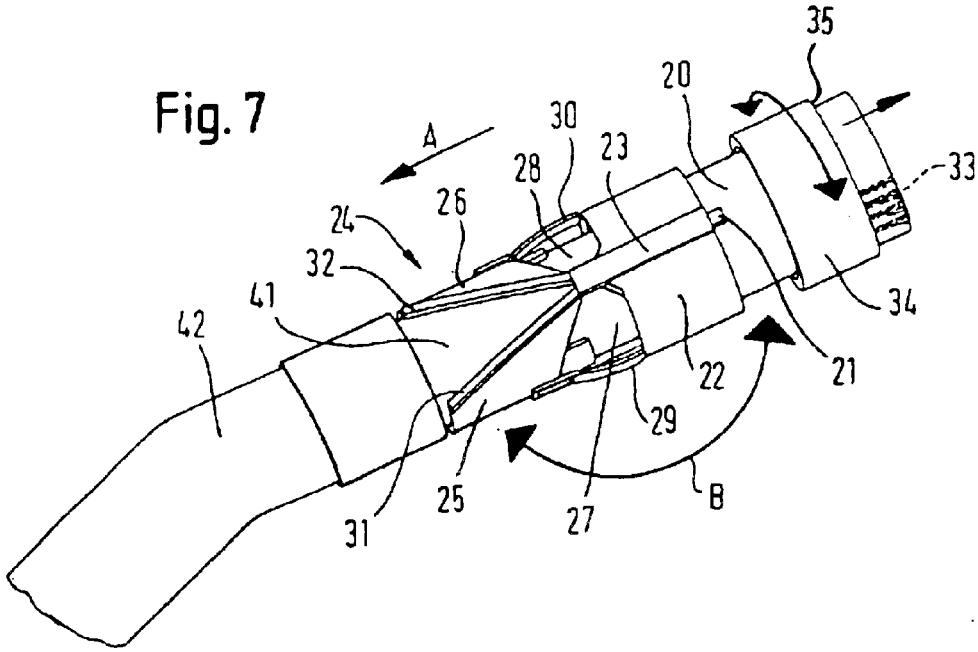
FIG. 7 is a fragmentary, perspective view of a fourth embodiment of the accessory unit according to the invention.

Instead of using folding bellows 27, 28, it is also possible for no folding bellows 27, 28 to be present and, according to FIG. 7, for the tube end component 41 to be pushed into the base body 20 to such an extent that an air-tight closure is produced between the base body 20 and the tube end component, With use of the nozzle 24 shown in FIG. 9 as an upholstery nozzle, if there are no folding bellows 27, 28 present, the sleeve 22 is advanced, in the direction of the arrow C, as far as a radially outwardly projecting border 46, provided on the outside of the elements, until an air-tight closure is produced between the sleeve 22 and the border 46.

Figure 10:
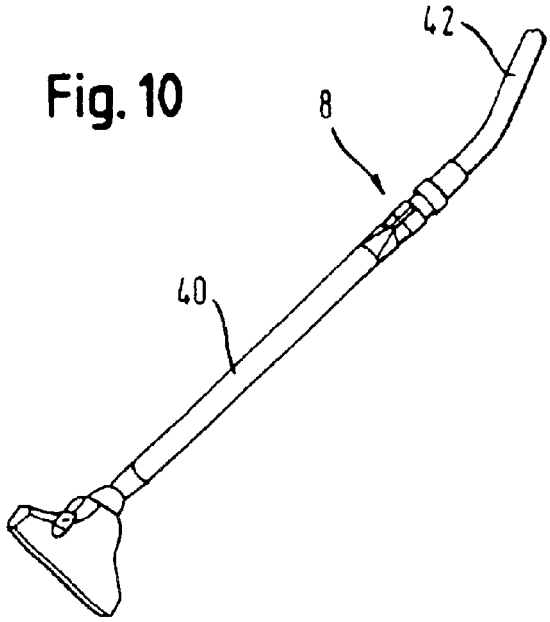
FIG. 10 is a fragmentary, perspective view of the accessory unit of FIG. 7 in an integrated position.

In the position illustrated in FIG. 7, it is possible for the accessory unit 8 to be integrated between the suction tube 40 and a further suction tube 42 as shown in FIG. 10. Depending on the type of usage desired, it is, then, possible for the user to remove the suction tube 40 together with the tube end component 41 to allow the nozzle 24 to be used as a furniture nozzle (FIG. 8) or as an upholstery nozzle (FIG. 9). If the accessory unit 8 is flipped around and pushed into the suction tube 42 on the side of the nozzle 24, the furniture brush 33 is, then, exposed.

Figure 11:
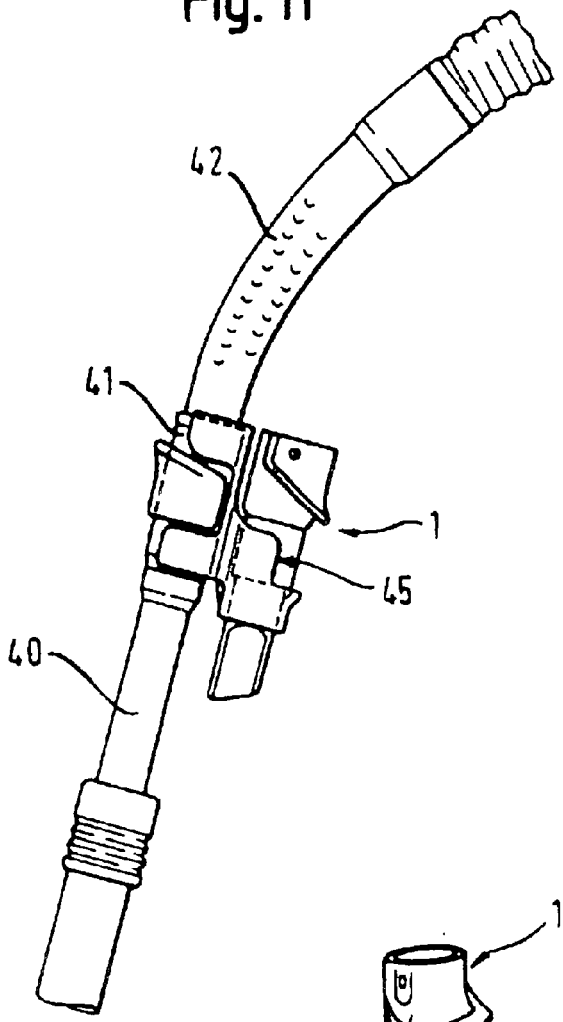
FIG. 11 is a fragmentary, perspective view of an accessory unit according to the invention in a snap enclosure of a vacuum hose.

According to FIG. 11, the accessory unit 1 is fastened on the tube end component 41 by a snap-enclosure 45 of an elastic material.

Figure 12:
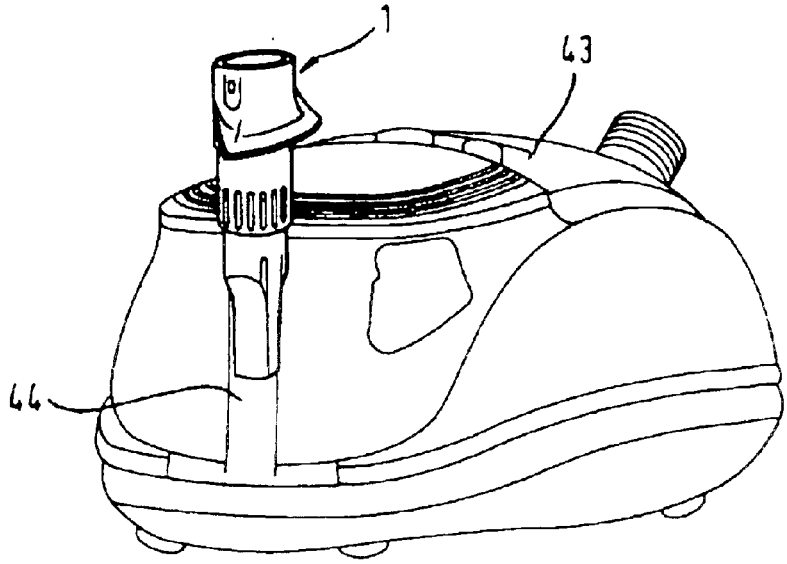
FIG. 12 is a fragmentary, perspective view of an accessory unit according to the invention in a mount of a vacuum housing.

In another embodiment shown in FIG. 12, a mount 44, which accommodates the accessory unit 1, is provided on a vacuum cleaner housing 43.

According to the invention, the base body 20 is plugged, by way of its end side that has the furniture brush 33, either onto a vacuum-cleaner tube component 42 or into a vacuum-cleaner tube component 42.

The displacement mechanism for the furniture nozzle can also be disposed in a displaceable manner on the inside of the base body 20.

The accessory unit can be disposed in a removable manner in an open-ended handle, the handle being disposed on a suction-hose/suction-tube unit of a vacuum cleaner.

Likewise, according to the invention, it is possible for the accessory unit 1, 8 to be plugged into a mount disposed on a handle. It is, alternatively, possible for the accessory unit 1, 8 to be fitted on a swing-out handle.

We claim:

1. An accessory unit of vacuum cleaner, comprising:

a base body; and a plurality of accessory parts including a crevice nozzle and at least one of a furniture nozzle and a furniture brush, said accessory parts being connected in at least one of a force-fitting manner and a form-fitting manner to said base body, said crevice nozzle telescopically extending out of said base body.

2. The accessory unit according to claim 1, wherein said crevice nozzle has two telescopically extensible parts.

3. The accessory unit according to claim 2, wherein said telescopically extensible parts are tube components disposed one inside the other.

4. The accessory unit according to claim 2, wherein said telescopically extensible parts have end positions and are latched in said end positions.

5. The accessory unit according to claim 1, wherein said crevice nozzle has first and second parts, said first part disposed inside said second part and telescopically extending from said second part.

6. The accessory unit according to claim 5, wherein said first and second parts have end positions and are removably latchable in said end positions.

7. The accessory unit according to claim 1, wherein:

said crevice nozzle telescopically extends out of said base body in an extension direction;

said base body has a side disposed opposite said crevice nozzle with respect to said extension direction; and said accessory parts include a furniture brush disposed on said side opposite said crevice nozzle.

8. The accessory unit according to claim 1, wherein:

said base body has an end side and a lateral wall; and said parts include a furniture brush, said furniture brush having a sleeve enclosing said lateral wall of said base body in an circular manner and extending beyond said end side by rotation of said sleeve.

9. The accessory unit according to claim 8, wherein:

said base body has a longitudinal direction;

a sleeve is displaceably disposed on said base body; and said parts form on said base body a nozzle of two elements symmetrical with respect to one another in said longitudinal direction, said two elements having hinges pivotally mounting said two elements on said base body between a swung-together position in which said elements form said crevice nozzle and a swung-out position in which said elements form said furniture nozzle, said sleeve pivoting said elements when displaced on said base body.

10. The accessory unit according to claim 1, wherein:

said base body has a longitudinal direction;

a sleeve is displaceably disposed on said base body; and said parts form on said base body a nozzle of two elements symmetrical with respect to one another in said longitudinal direction, said two elements having hinges pivotally mounting said two elements on said base body between a swung-together position in which said elements form said crevice nozzle and a swung-out position in which said elements form said furniture nozzle, said sleeve pivoting'said elements when displaced on said base body.

11. A vacuum cleaner, comprising;

a hose assembly;

a vacuum housing communicating with said hose assembly; and an accessory unit removably connected to said hose assembly and having:

a base body; and a plurality of accessory parts including a crevice nozzle and at least one of a furniture nozzle and a furniture brush, said accessory parts being connected in at least one of a force-fitting manner and a form-fitting manner to said base body, said crevice nozzle telescopically extending out of said base body.

12. An accessory unit, comprising:

a base body having an end side and a lateral wall; and a plurality of accessory parts, including a furniture brush and at least one of a crevice nozzle and a furniture nozzle, said accessory parts being connected in at least one of a force-fitting manner and a form-fitting manner to said base body, said furniture brush having a sleeve enclosing said lateral wall of said base body in a circular manner and extending beyond said end side by rotation of said sleeve.

13. The accessory unit according to claim 12, wherein said furniture brush is disposed at said end side of said base body and is to be plugged, by said end side, one of onto and into a vacuum-cleaner tube component.

14. The accessory unit according to claim 12, wherein said accessory parts include a furniture nozzle disposed pivotally on an outside of said base body and pivoting from a rest position to an operating position.

15. The accessory unit according to claim 14, wherein:

said furniture nozzle has a furniture nozzle body defining two openings; and said base body has an outside with two protuberances respectively communicating with said two openings to pivotally mount said furniture nozzle to said base body.

16. The accessory unit according to claim 14, wherein said furniture nozzle is arrested removably on said base body in at least one of an operating position and a rest position.

17. The accessory unit according to 16, wherein said furniture nozzle:

is of an elastic material; and has an interrupted wall permitting said furniture nozzle to pivot out of said operating position into said rest position, in which said furniture nozzle is rotated approximately 180° with respect to said operating position.

18. A vacuum cleaner, comprising:

a hose assembly;

a vacuum housing communicating with said hose assembly; and an accessory unit removably connected to said hose assembly and having:

a base body having an end side and a lateral wall; and a plurality of accessory parts, including a furniture brush and at least one of a crevice nozzle and a furniture nozzle, said accessory parts being connected in at least one of a force-fitting manner and a form-fitting manner to said base body, said furniture brush having a sleeve enclosing said lateral wall of said base body in a circular manner and extending beyond said end side by rotation of said sleeve.

19. An accessory unit, comprising:

a base body having a longitudinal direction;

a sleeve displaceably disposed on said base body; and a plurality of accessory parts, including a crevice nozzle and a furniture nozzle, said parts being connected in at least one of a force-fitting manner and a form-fitting manner to said base body and forming on said base body a nozzle of two elements symmetrical with respect to one another in said longitudinal direction, said two elements having hinges pivotally mounting said two elements on said base body between a swung-together position in which said elements form said crevice nozzle and a swung-out position in which said elements form said furniture nozzle, said sleeve pivoting said elements when displaced on said base body.

20. The accessory unit according to claim 19, further comprising lugs connecting said elements to said sleeve.

21. The accessory unit according to claim 19, further comprising sealing surfaces connecting said elements to said base body.

22. The accessory unit according to claim 21, wherein said sealing surfaces are elastic folding bellows.

23. The accessory unit according to claim 19, wherein said elements swing to an acute angle with respect to one another to accommodate therebetween a tube component in an air-tight manner.

24. The accessory unit according to claim 19, wherein:

said elements each have:

surfaces curved with respect to one another;

outer lateral borders; and ribs on said outer lateral borders having a height corresponding to or less than half a height of each respective rib on said base body; and said elements form a mouth opening in said swung-together position for said crevice nozzle.

25. The accessory unit according to claim 19, wherein:

said base body has a side opposite said swung-together element and a lateral wall with an end side;

on said side of said base body opposite said swung-together element, a furniture brush, which extends in ring form beyond said end side of said lateral wall of said base body, is fitted on said base body.

26. A vacuum cleaner, comprising:

a hose assembly;

a vacuum housing communicating with said hose assembly; and an accessory unit removably connected to said hose assembly and having:

a base body having a longitudinal direction;

a sleeve displaceably disposed on said base body; and a plurality of accessory parts, including a crevice nozzle and a furniture nozzle, said parts being connected in at least one of a force-fitting manner and a form-fitting manner to said base. Body and forming on said base body a nozzle of two elements symmetrical with respect to one another in said longitudinal direction, said two elements having hinges pivotally mounting said two elements on said base body between a swung-together position in which said elements form said crevice nozzle and a swung-out position in which said elements form said furniture nozzle, said sleeve pivoting said elements when displaced on said base body.

27. A accessory unit of vacuum cleaner, comprising:

a base body having an end side and a lateral wall; and a plurality of accessory parts, including a furniture brush, a crevice nozzle, and a furniture nozzle, said accessory parts being connected in at least one of a force-fitting manner and a form-fitting manner to said base body, said furniture brush having a sleeve enclosing said lateral wall of said base body in a circular manner and extending beyond said end side by rotation of said sleeve, said crevice nozzle telescopically extending out of said base body.

* * * * *